US007273242B2

(12) United States Patent
Godin Flott et al.

(10) Patent No.: US 7,273,242 B2
(45) Date of Patent: Sep. 25, 2007

(54) KNOB ASSEMBLY FOR A DOOR

(76) Inventors: Devany Dawn Godin Flott, 3619 N. Copenhagen Dr., Avondale, AZ (US) 85323; Michael Raymond Godin, 1105 Crest Rd., Papillion, NE (US) 68046

( * ) Notice: Subject to any disclaimer, the term of this patent is extended or adjusted under 35 U.S.C. 154(b) by 101 days.

(21) Appl. No.: 11/132,973

(22) Filed: May 18, 2005

(65) Prior Publication Data

US 2006/0261609 A1 Nov. 23, 2006

(51) Int. Cl.
*E05B 1/00* (2006.01)
*E05C 3/06* (2006.01)

(52) U.S. Cl. ..... 292/347; 292/195; 292/336.3

(58) Field of Classification Search ..... 292/96, 292/336.3, 347–348, DIG. 37, DIG. 64, 352, 292/DIG. 27, DIG. 3; 70/224, 214, 218; 16/413

See application file for complete search history.

(56) References Cited

U.S. PATENT DOCUMENTS

| | | | | | |
|---|---|---|---|---|---|
| 793,087 | A * | 6/1905 | McVitty | ..... | 70/214 |
| 2,000,111 | A * | 5/1935 | Weis | ..... | 70/214 |
| 2,046,342 | A * | 7/1936 | Muck et al. | ..... | 292/352 |
| 3,206,238 | A * | 9/1965 | Speight et al. | ..... | 292/195 |
| 4,082,351 | A | 4/1978 | Chrones | | |
| 4,253,690 | A | 3/1981 | Hollander | | |
| 4,575,141 | A * | 3/1986 | Burns | ..... | 292/336.3 |
| 4,799,371 | A * | 1/1989 | Duncan | ..... | 70/214 |
| 5,174,617 | A | 12/1992 | Huber et al. | | |
| 5,217,265 | A | 6/1993 | Lerner et al. | | |
| 5,409,271 | A | 4/1995 | Hoffmann | | |
| 5,865,480 | A | 2/1999 | Bain, Jr. et al. | | |
| 5,927,769 | A | 7/1999 | Pullen | | |
| 5,956,808 | A | 9/1999 | Tom | | |
| 6,179,352 | B1 * | 1/2001 | Schneeberger | ..... | 292/347 |
| 6,546,763 | B1 | 4/2003 | Pielach | | |
| 6,874,198 | B2 | 4/2005 | Renaud | | |

* cited by examiner

*Primary Examiner*—Brian E. Glessner
*Assistant Examiner*—Alyson Merlino
(74) *Attorney, Agent, or Firm*—Jordan M. Meschkow; Lowell W. Gresham; Charlene R. Jacobsen

(57) ABSTRACT

A knob assembly (22) for a door (20) includes a spindle (30) and a latch (108) in communication with the spindle (30) and extendable from an edge (132) of the door (20). An inner knob portion (36) is secured to the spindle (30), and an outer knob portion (38) faces the inner knob portion and freely rotates on the spindle (30). A lug (102, 104) projects from a second surface (106) of the outer knob portion (38) for engagement with a notch (58) formed in a first surface 54 of the inner knob portion (36). The outer knob portion (38) is selectively operable to positively engage the lug (102, 104) with the notch (58) for enabling rotation of the spindle (30) in response to rotation of the outer knob portion (38) to move the latch (108) from a normally latched position (110) to an unlatched position (146).

8 Claims, 6 Drawing Sheets

KNOB ASSEMBLY FOR A DOOR

TECHNICAL FIELD OF THE INVENTION

The present invention relates to the field of rotary-type door latching mechanisms. More specifically, the present invention relates to a door knob assembly that is resistant to operation by an unauthorized person.

BACKGROUND OF THE INVENTION

In many countries, drowning is one of the leading causes of unintentional injury-related deaths to children ages fourteen and under. More than eighty percent of the drownings occur in residential backyard pools or spas. The speed with which swimming pool submersions and drowning can occur is of special concern. By the time a child's absence is noted, the child may have already drowned.

Pool safety guidelines recommend the use of layers of barrier protection between the child and water to warn and impede. These layers of protection include, for example, alarms on doors and windows leading to the water, pool safety covers, a non-climbable, five-foot fence separating the pool/spa from the residence, and self-closing and self-latching gates and doors leading to the pool/spa with latches above a child's reach.

Regarding self-closing and self-latching gates and doors, the prior art includes latches which are located relatively high on the door or gate, typically at or above fifty inches above the threshold. Unfortunately, a determined child can usually find a chair or other device upon which to climb to operate the latch. This problem is exacerbated by the common use of lever door handles with self-closing and self-latching systems. Opening a lever door handle merely entails pressing down on the handle's flat surface, and pushing, pulling, or sliding open the door. As such, children and mentally impaired adults can readily operate lever door handle. Consequently, such a lever door handle mounted relatively high on the door or gate has proven to be ineffective.

The prior art also teaches of various lock and key arrangements to prevent child access. Such mechanisms, however, require a key for any person to use it. If the key is accessible, the prohibited area is as well, regardless of the user's age or mental acuity. Likewise, if the key is not available, in an emergency situation for example, the area will be inaccessible to all persons not possessing the key.

Yet another solution to the problem is to provide a latch mechanism that requires substantial strength to operate. Unfortunately, the elderly, handicapped, or other adults may not be strong enough to operate such a latch.

Accordingly, what is needed is a self-latching mechanism for a door or window that is difficult to operate by unauthorized individuals, such as, small children and those adults whose mental acuity is in some way diminished so as to warrant restricted access to a particular area, such as to a pool/spa area.

SUMMARY OF THE INVENTION

Accordingly, it is an advantage of the present invention that a knob assembly for a door is provided.

Another advantage of the present invention is that a knob assembly is provided that is difficult to operate by unauthorized individuals.

It is another advantage of the present invention that a knob assembly is provided that may be adapted for use on either sliding doors or hinged doors.

Yet another advantage of the present invention is that a knob assembly is provided that is simple in construction and cost effectively produced.

The above and other advantages of the present invention are carried out in one form by a knob assembly for a door. The knob assembly includes a spindle configured to extend through the door approximately perpendicular to a planar surface of the door, and a latch in communication with the spindle and extendable from an edge of the door, the latch being actuated in response to rotation of the spindle. An inner knob portion is fixedly secured to the spindle, the inner knob portion including a first surface. An outer knob portion freely rotates on the spindle, and includes a second surface facing the first surface. A lug projects from one of the first and second surfaces for engagement with a notch formed in another of the first and second surfaces. The outer knob portion is selectively operable to positively engage the lug with the notch for enabling rotation of the spindle when the outer knob portion is rotated to move the latch from a normally latched position to an unlatched position.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

The present invention is directed toward a knob assembly for a door that is resistant to operation by an unauthorized individual, such as a small child or a mentally impaired adult. The knob assembly is particularly useful when coupled to an exterior door for preventing the unauthorized individual from going through the door into a prohibited area, such as a pool area, a tool shed, electrical equipment area, and so forth. However, the invention can also be applied to interior doors to keep children and mentally impaired adults out of selected rooms or other spaces, such as a work shop, study, bedroom, or the like. In addition, the invention can be applied to gates and windows to keep the unauthorized individual from going through the gate or window.

Figure 1:
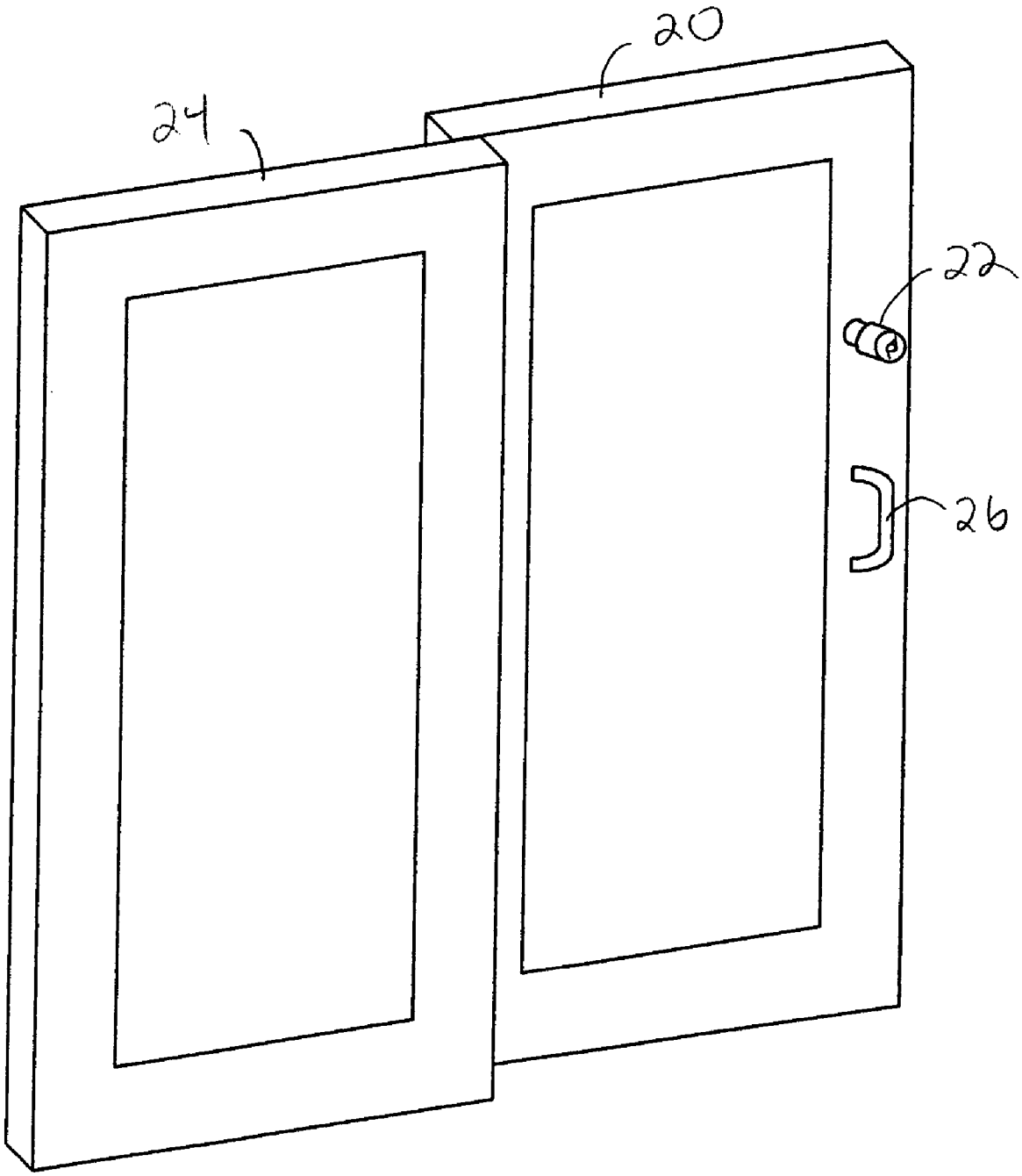
FIG. 1 shows a perspective view of an exemplary sliding door to which a knob assembly of the present invention may be attached.

FIG. 1 shows a perspective view of an exemplary sliding door 20 to which a knob assembly 22 of the present invention may be attached. Sliding door 20 is a conventional sliding door that typically slides in a bottom floor track (not shown) from the closed position shown in FIG. 1 to an open position in which sliding door 20 is positioned behind an adjacent fixed door 24. Sliding door 20 may be an exterior door that opens to a swimming pool or spa area. Consequently, sliding door 20 may be outfitted with a self-closing mechanism (not shown) so that sliding door 20 cannot be inadvertently left open.

Knob assembly 22 is a self-latching mechanism that can work cooperatively with the self-closing mechanism, so that when sliding door 20 automatically closes, knob assembly 22 subsequently latches to prevent passage through the door of an unauthorized individual, such as a small child or mentally impaired adult.

Sliding door 20 includes a conventional handle 26 that may be grasped to slide door 20 into an open position. Knob assembly 22 may be positioned above handle 26, such as at a height of fifty inches above the threshold. In such a manner, a procedure for opening sliding door 20 may entail manipulation of both handle 26 and knob assembly 22. The present invention does not, however, require the use of handle 26 in conjunction with knob assembly 22. Rather, knob assembly 22 may be utilized in lieu of handle 26.

For illustrative purposes, knob assembly 22 of the present invention is described in connection with its use on a sliding door. However, it will become apparent in the ensuing discussion that knob assembly 22 may be readily adapted for use on a variety of hinged doors, gates, windows, and so forth.

Figure 2:
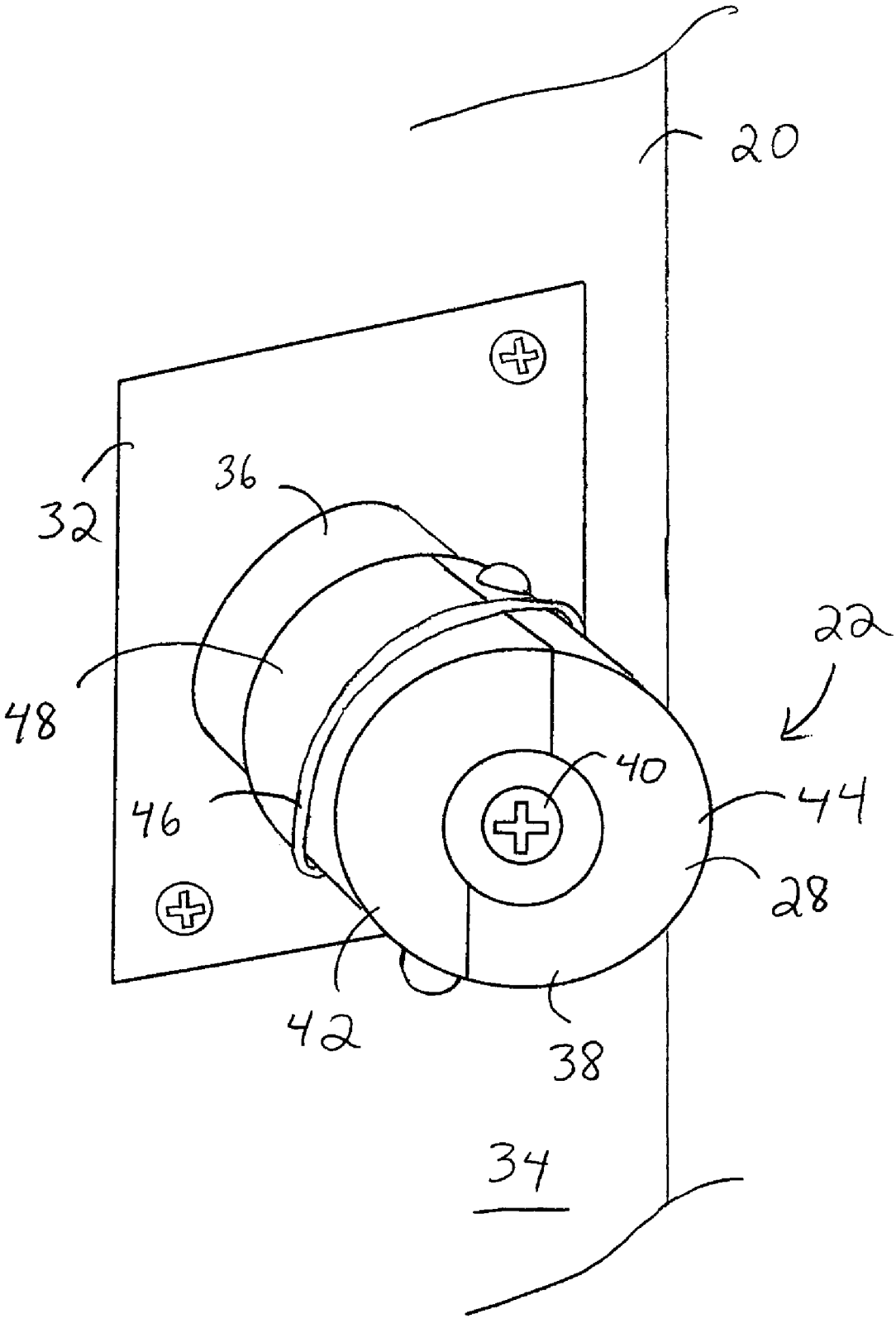
FIG. 2 shows a perspective view of a knob assembly in accordance with a preferred embodiment of the present invention.

FIG. 2 shows a perspective view of knob assembly 22 in accordance with a preferred embodiment of the present invention. Knob assembly 22 generally includes a rotatable door knob 28 carried by an internal spindle 30 (FIG. 5) mounted via a door plate 32 to sliding door 20. Rotatable door knob 28 is positioned on an interior planar surface 34 of sliding door 20. An exterior surface (not visible) of sliding door 20 may also include a corresponding knob or lever door handle (not shown) so that sliding door 20 may correspondingly be opened from the exterior.

Door knob 28 includes an inner knob portion 36 fixedly secured to spindle 30 (discussed below) and an outer knob portion 38 freely rotating on spindle 30. A fastener 40 retains outer knob portion 38 on spindle 30, while enabling outer knob portion 38 to rotate. Inner knob portion 36 and spindle 30 will be discussed in greater detail in connection with FIGS. 3-5.

Outer knob portion 38 includes a first section 42 and a second section 44. First and second sections 42 and 44, respectively, are held in abutment by a resilient member 46 positioned about a circumference 48 of outer knob portion 38. First and second sections 42 and 44, respectively, of outer knob portion 38 will be discussed in greater detail in connection with FIGS. 6-8. In addition, manipulation of outer knob portion 38 to operate door knob 28 will be discussed in connection with FIGS. 9-13.

Figure 3:
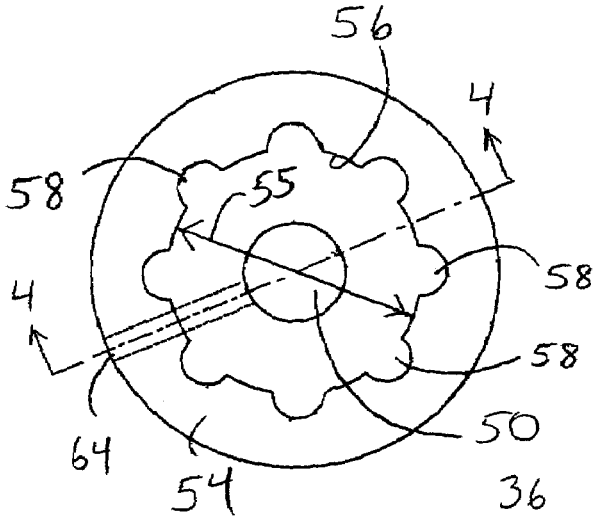
FIG. 3 shows a front view of an inner knob portion of the knob assembly of FIG. 2.
Figure 4:
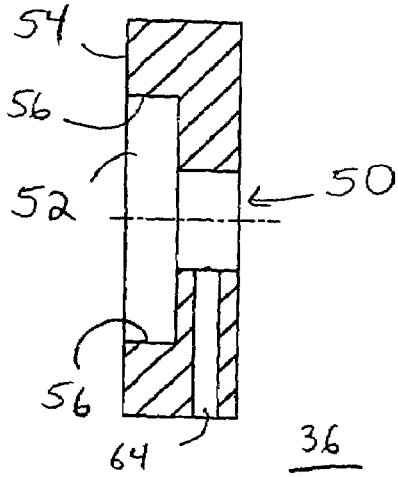
FIG. 4 shows a sectional view of the inner knob portion of FIG. 3 along section lines 4-4.
Figure 5:
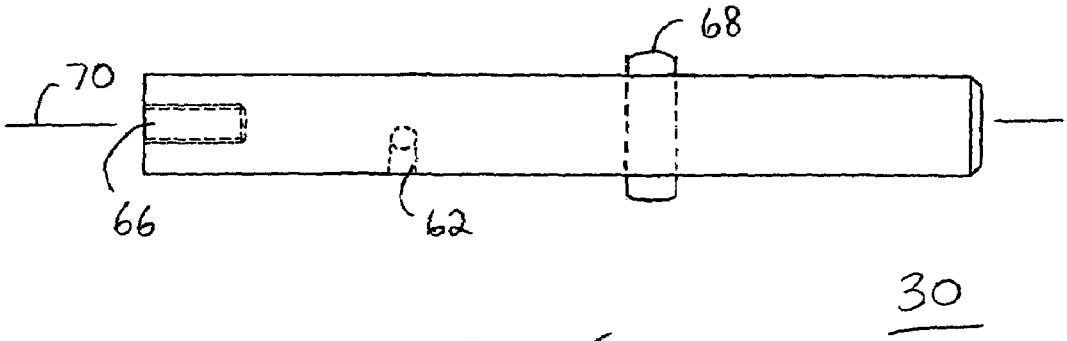
FIG. 5 shows a side view of a spindle of the knob assembly of FIG. 2.

Referring to FIGS. 3-5 in connection with FIG. 2, FIG. 3 shows a front view of inner knob portion 36 of knob assembly 22. FIG. 4 shows a sectional view of inner knob portion 36 of FIG. 3 along section lines 4-4, and FIG. 5 shows a side view of spindle 30 of knob assembly 22.

Inner knob portion 36 is a generally cylindrical element having a central opening 50 through which spindle 30 is routed. Inner knob portion 36 further includes a cavity 52 extending inwardly from a first surface 54 of inner knob portion 36. Cavity 52, having a cavity diameter 55, is defined by a sidewall 56. A plurality of notches 58 are formed at intervals in sidewall 56. In particular, notches 58 are arranged as opposing pairs of notches 58 about sidewall 56. The function of notches 58 will be discussed in further detail below.

Spindle 30 includes a threaded opening 62 extending radially therein. A corresponding threaded passage 64 also extends radially through inner knob portion 36 from the perimeter to central opening 50. A setscrew (not shown) may be directed through passage 64 and into threaded opening 62 of spindle 30 so as to fixedly secure inner knob portion 36 to spindle 30. Spindle 30 further includes a threaded passage 66 extending inwardly at an end of spindle 30 into which fastener 40 is threaded so as to retain outer knob portion 38 onto spindle 30. A post 68 extends approximately perpendicular to a longitudinal axis 70 of spindle 30. Post 68 functions to actuate a latch mechanism, discussed below.

Figure 6:
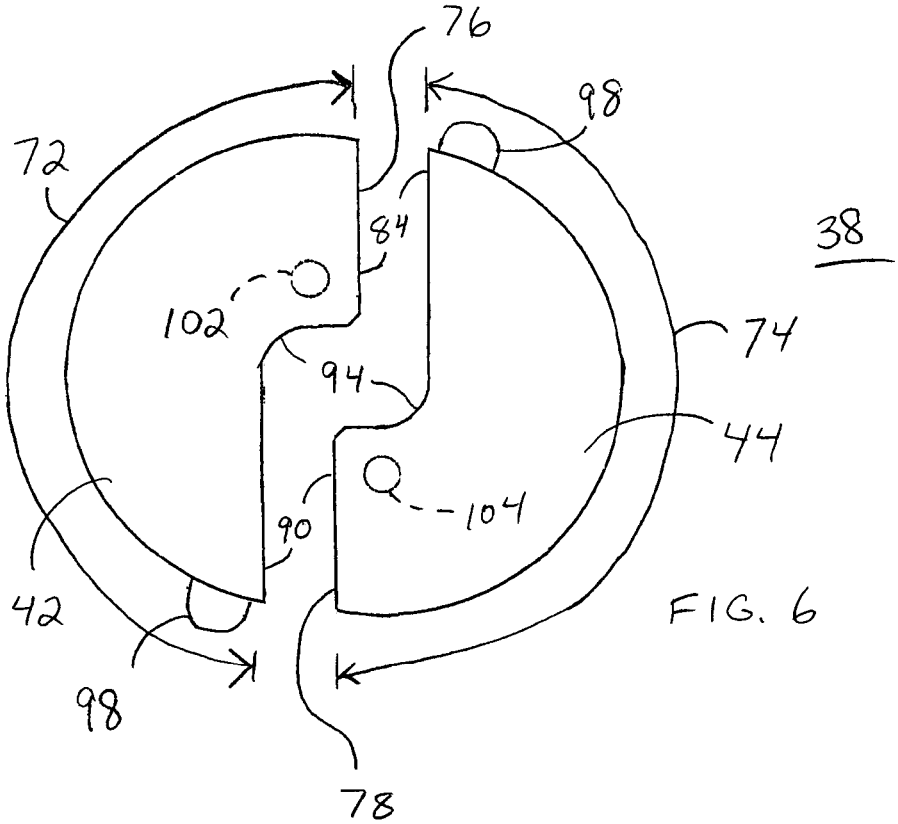
FIG. 6 shows an exploded front view of an outer knob portion of the knob assembly of FIG. 2.
Figure 7:
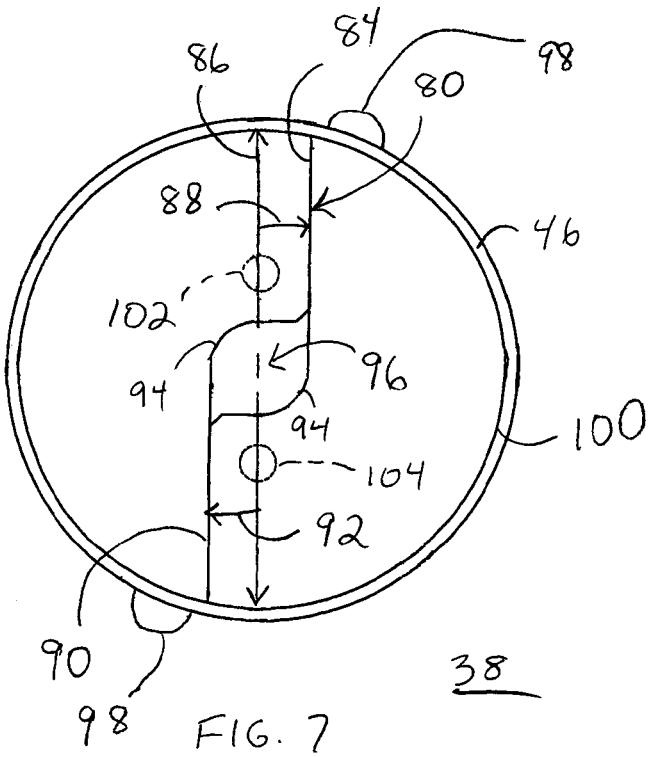
FIG. 7 shows a front view of the outer knob portion in an assembled configuration.
Figure 8:
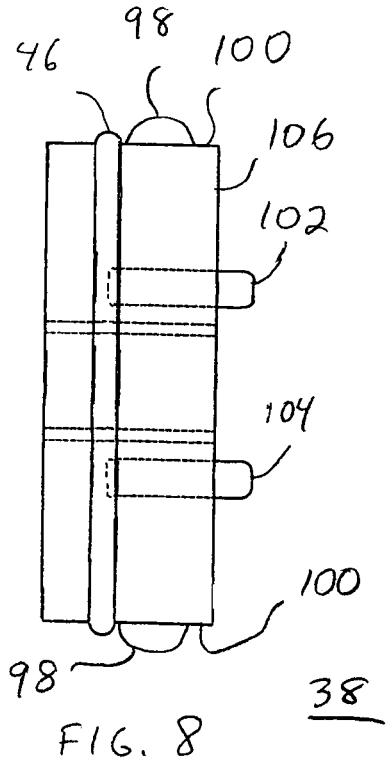
FIG. 8 shows a side view of the outer knob portion.

Referring to FIGS. 6-8 in connection with FIG. 2, FIG. 6 shows an exploded front view of outer knob portion 38 of knob assembly 22. FIG. 7 shows a front view of outer knob portion 38 in an assembled configuration, and FIG. 8 shows a side view of outer knob portion 38.

First section 42 exhibits a first outer perimeter 72 that circumscribes approximately a first half of circumference 48 of outer knob portion 38, and second section 44 exhibits a second outer perimeter 74 that circumscribes approximately a second half of circumference 48. First section 42 of outer knob portion 38 further includes a first mating edge 76. Similarly, second section 44 of outer knob portion 38 includes a second mating edge 78 that abuts first mating edge 76 to form an abutment line 80 arranged approximately perpendicular to longitudinal axis 70 (FIG. 5) of spindle 30 (FIG. 5).

Each of first and second mating edges 76 and 78, respectively, includes a first straight segment 84 offset from a diameter 86 of outer knob portion 38 in a first direction, represented by an arrow 88, and a second straight segment 90 offset from diameter 86 in a second direction, represented by an arrow 92. A curved segment 94 is interposed between first and second straight segments 84 and 90, respectively. Curved segment 94 crosses diameter 86 to interconnect first and second straight segments 84 and 90.

Curved segment 94 of first mating edge 76 and curved segment 94 of second mating edge 78 are oppositely curved to form a passage 96 between first and second sections 42 and 44, respectively. Spindle 30 (FIG. 5) is positioned in passage 96, and resilient member 46 holds first and second sections 42 and 44 in abutment. Each of first and second sections 42 and 44, respectively, further includes means, in the form of protrusions 98, extending from a perimeter 100 of outer knob portion 38 for indicating a hand placement strategy for selectively operating outer knob portion 38, discussed below. Although protrusions 98 are shown, those skilled in the art will recognize that indicating means may alternatively include dips, curves, multiple low profile bumps, ridges, and the like. In addition, although protrusions 98 are shown as extending from first and second sections 42 and 44, respectively, of outer knob portion 38, indicators may alternatively be place on resilient member 46.

A first lug 102 and a second lug 104 project from a second surface 106 of outer knob portion 38 configured to face first surface 54 (FIG. 4) of inner knob portion 36. More specifically, first lug 102 projects from second surface 106 of first section 42, and second lug 104 projects from second surface 106 of second section 44. First lug 102 is aligned with second lug 104 along diameter 86 of outer knob portion 38.

Figure 9:
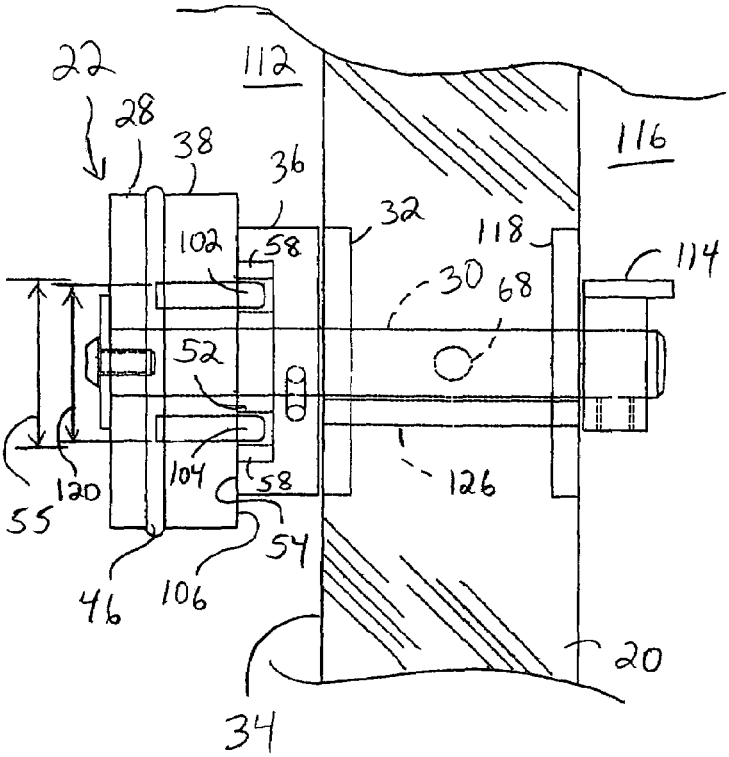
FIG. 9 shows a side view of the knob assembly of FIG. 2.
Figure 10:
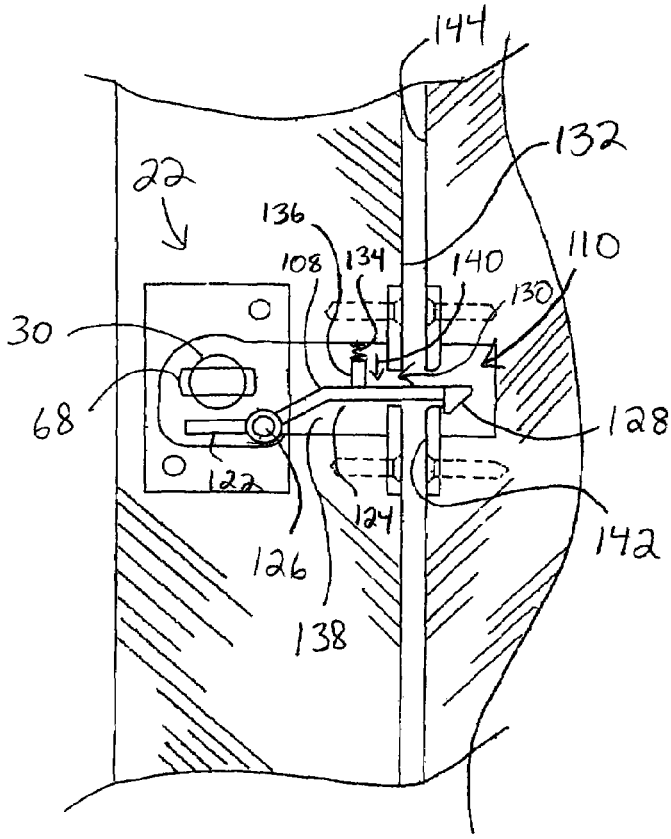
FIG. 10 shows a side view of a latch mechanism of the knob assembly of FIG. 2 in a normally latched position.

Referring to FIGS. 9-10, FIG. 9 shows a side view of knob assembly 22, and FIG. 10 shows a side view of a latch mechanism 108 of the knob assembly 22 in a normally latched position 110. The side view of FIG. 9 is shown without latch mechanism 108 so as to more clearly illustrate the cooperative structure of inner knob portion 36, outer knob portion 38, and spindle 30 of knob 28. Likewise, the side view of FIG. 10 is shown without knob 28 so as to more simply illustrate latch mechanism 108.

As shown in FIG. 9, spindle 30 extends through door 20 approximately perpendicular to planar surface 34 of door 20. Knob 28, including inner and outer knob portions 36 and 38, respectively, are positioned on an interior side 112 of door 20. A corresponding lever door handle 114 is positioned on an exterior side 116 of door 20. In the embodiment shown, door plate 32 and an exterior door plate 118 are inset into door 20. However, such is not a requirement of the present invention. Alternatively, door plate 32 and exterior door plate 118 may be mounted on corresponding surfaces of door 20.

Inner knob portion 36 is located closest to door plate 32 and is fixedly secured to spindle 30, as discussed above. Outer knob portion 38 is oriented with second surface 106 of outer knob portion 38 facing first surface 54 of inner knob portion 36. In normally latched position 110, first and second lugs 102 and 104 reside in cavity 52, but are not engaged with a pair of notches 58. That is, a distance 120 between an outside edge of first and second lugs 102 and 104, respectively, is less than diameter 55 of cavity 52. Since outer knob portion 38 is not fixedly secured to spindle 30, and distance 120 is less than cavity diameter 55, outer knob portion 38 freely rotates on spindle 30 while spindle 30 remains stationary.

As shown in FIG. 10, latch mechanism 108 includes a first tab section 122 and a second tab section 124 pivotally mounted on a pin 126 extending through door 20. Second tab section 124 includes a hooked finger 128 extending through an opening 130 in an edge 132 of door 20. A spring 134 coupled with a projection 136 on second tab section 124, extends substantially vertically to abut a top wall of a hollowed portion 138 of door 20. Spring 134 imparts a spring force 140 that forces second tab section 124 downward, pivoting about pin 126, so that hooked finger 128 is normally engaged with a strike plate 142 mounted on a doorjamb 144.

Due to the structure described above, when in normally latched position 110, outer knob portion 38 freely rotates about spindle 30, while spindle 30 remains stationary, and hooked finger 128 remains engaged with strike plate 142. As such, a young child or a mentally impaired adult can rotate outer knob portion 38 without actually disengaging hooked finger 128 from strike plate 142.

Figure 11:
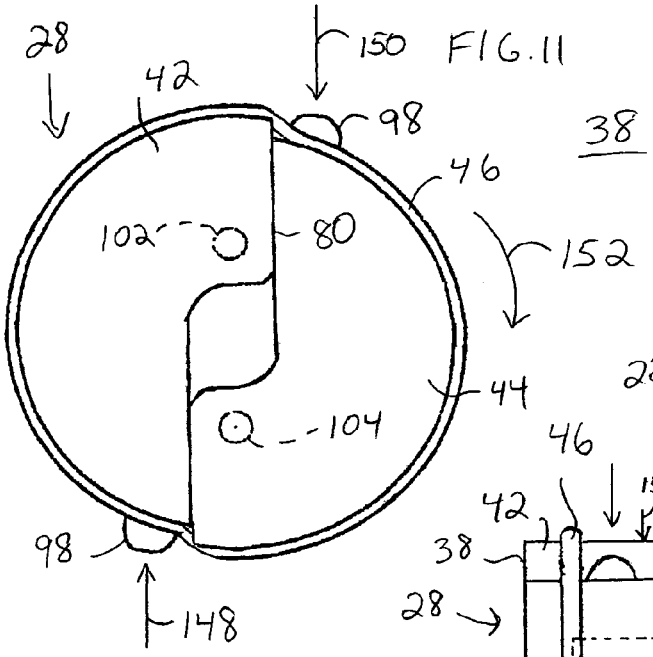
FIG. 11 shows a front view of the outer knob portion in an actuated state.
Figure 12:
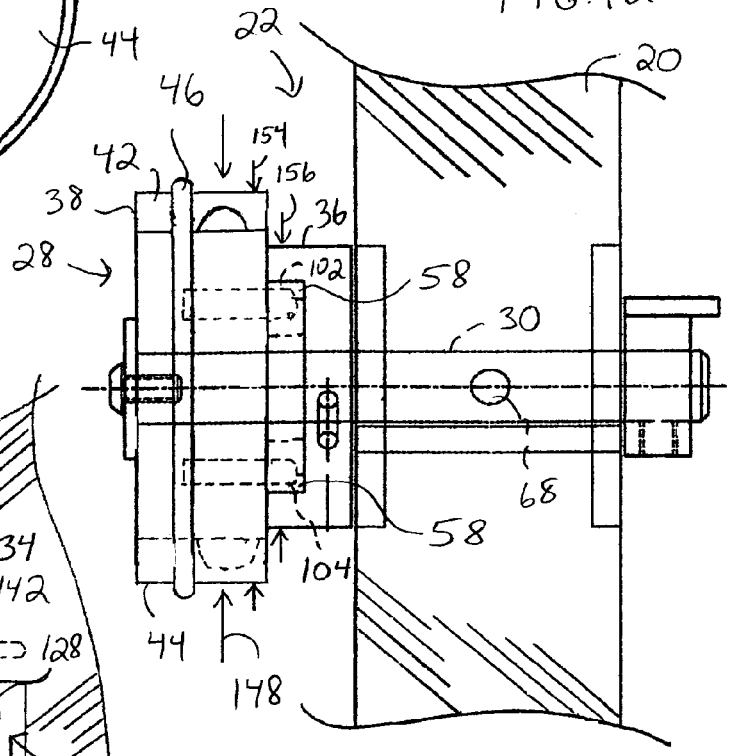
FIG. 12 shows a side view of the knob assembly in an actuated state.
Figure 13:
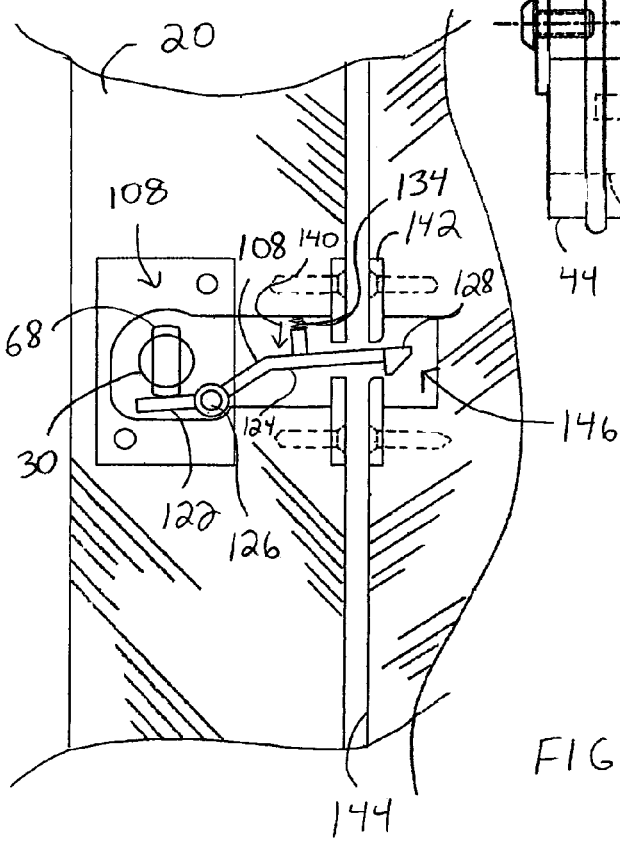
FIG. 13 shows a side view of the latch mechanism of FIG. 10 in an unlatched position.

Referring to FIGS. 11-13, FIG. 11 shows a front view of outer knob portion 38 manipulated to an actuated state. FIG. 12 shows a side view of knob assembly 22 in the actuated state, and FIG. 13 shows a side view of latch mechanism 108 in an unlatched position 146. Like FIGS. 9-10, the side view of FIG. 12 is shown without latch mechanism 108 so as to more clearly illustrate the cooperative structure of inner knob portion 36, outer knob portion 38, and spindle 30 of knob 28. Likewise, the side view of FIG. 13 is shown without knob 28 so as to more simply illustrate latch mechanism 108.

The objective of knob assembly 22 on door 20 is to thwart attempts by a small child or mentally impaired adult to successfully manipulate door knob 28. To that end, successful manipulation of door knob 28 entails concurrently applying opposing forces on first and second sections 42 and 44, respectively, of outer knob portion 38 while rotating outer knob portion 38. More specifically, a first directional force 148 is applied at the one of protrusions 98 located on first section 42 of outer knob portion 38 and a second directional force 150 is applied at the one of protrusions 98 on second section 44 of outer knob portion 38. For example, a right-handed individual may apply first directional force 148 with his or her thumb and second directional force 150 with his or her index and middle fingers. Conversely, a left-handed individual may apply first directional force 148 with his or her index and middle fingers and second directional force 150 with his or her thumb. Protrusions 98 indicate a hand placement strategy for appropriately grasping first and second sections 42 and 44, respectively, even if outer knob portion 38 is not clearly visible.

The opposing first and second directional forces 148 and 150, respectively, cause first and second sections 42 and 44 to move in opposing directions along abutment line 80. Since first lug 102 is located on first section 42 and second lug 104 is located on second section 44, this sliding movement causes first and second lugs 102 and 104 to move farther apart.

In addition to application of first and second directional forces 148 and 150, a rotation force, represented by an arrow 152, is applied to rotate outer knob portion 38. As outer knob portion 38 is rotated, first and second lugs 102 and 104 align with and positively engage with an opposing pair of notches 58 formed in sidewall 56 (FIG. 4) of cavity 52 (FIG. 4).

This engagement results in the union of outer knob portion 38 with inner knob portion 36. Since inner knob portion 36 is fixedly secured to spindle 30, rotation of outer knob portion 38 with first and second lugs 102 and 104 engaged in notches 58 enables rotation of spindle 30. When spindle 30 rotates, post 68 comes into contact with first tab section 122 of latch mechanism 108. The contact of post 68 with first tab section 122 causes latch mechanism 108 to pivot about pin 126 to oppose spring force 140 and push second tab section 124 upward so that hooked finger 128 becomes disengaged from strike plate 142. Once hooked finger 128 is disengaged from strike plate 142, sliding door 20 can be slid to an open position.

It should be recalled that first and second sections 42 and 44, respectively, are held in abutment by resilient member 46. Resilient member 46 may be an elastic o-ring or band encircling first and second sections 42 and 44. Accordingly, when first directional force 148 and second directional force 150 are removed, i.e., the individual releases knob 28, the elasticity of resilient member 46 causes first and second sections 42 and 44 to slide along abutment line 80 back to their original positions (shown in FIG. 7). Once back in their original positions, first and second lugs 102 and 104 disengage from notches 58 and spring force 140 of spring 134 opposes the force of post 68 on first tab section 122. Consequently, spindle 30 rotates so that post 68 moves out of contact with first tab section 122 (shown in FIG. 10), and second tab section 124 moves downward, pivoting about pin 126, so that hooked finger 128 re-engages with strike plate 142 on doorjamb 144. Thus, release of first and second sections 42 and 44, respectively of outer knob portion 38 causes knob 28 to automatically return to latched position 110 (FIG. 10).

In a preferred embodiment, inner knob portion 36 includes a number of opposing pairs of notches 58. For example, as illustrated in FIG. 3, inner knob portion 36 includes eight notches 58, for a total of four pairs of opposing notches. As first and second directional forces 148 and 150 are applied, enough rotation of outer knob portion 38 is required to cause first and second lugs 102 and 104 to align with and slide into notches 58. By positioning notches 58 at thirty degree intervals, only slight rotation 152 of outer knob portion 38 is called for to align first and second lugs 102 and 104 with a pair of notches 58. Those skilled in the art will recognize that the total number of notches 58 need not be limited to eight. Rather, knob assembly 22 may be adapted to accommodate more or less notches depending upon lug diameter, knob diameter, and the desired degree of rotation of outer knob portion 38 to align lugs 102 and 104 with notches 58.

In a further preferred embodiment, a first diameter 154 of outer knob portion 38 is greater than a second diameter 156 of inner knob portion 36. Inner knob portion 36 is fixed to spindle 30. Thus, rotation of inner knob portion 36 will cause rotation of spindle 30 and subsequently move latch mechanism 108 into unlatched position 146, as described above. Outer knob portion 38 desirably has a greater diameter than inner knob portion 36 so that a young child or mentally impaired adult is less likely to attempt to rotate door knob 28 by grasping and turning inner knob portion 36.

Knob assembly 22 is described in connection with its use for latching and unlatching sliding door 20. However, those skilled in the art will recognize that the latch mechanism may alternatively be a spring latch or dead latch type that is actuated through rotation by a center spindle, such as spindle 30.

In summary, the present invention teaches a knob assembly for a door. Manipulation of the knob assembly entails the application of both opposing forces on split halves of the door knob, as well as concurrently applied rotation of the door knob. Thus, the knob assembly is difficult to operate by an unauthorized individual, such as a small child or a mentally impaired adult. The knob components are relatively simple in construction, entailing only a center spindle and selectively engaging elements of an inner knob portion and outer knob portion that can be inexpensively manufactured.

Although the preferred embodiments of the invention have been illustrated and described in detail, it will be readily apparent to those skilled in the art that various modifications may be made therein without departing from the spirit of the invention or from the scope of the appended claims. For example, the lug and notch configuration of the present invention may be reversed such that the lugs are located on the inner knob portion and the notches are located on the outer knob portion.

What is claimed is:

1. A knob assembly for a door comprising:

a spindle configured to extend through said door approximately perpendicular to a planar surface of said door;

a latch in communication with said spindle and extendable from an edge of said door, said latch being actuated in response to rotation of said spindle;

an inner knob portion fixedly secured to said spindle, said inner knob portion including a first surface and a cavity extending inwardly from said first surface, said cavity being defined by a side wall;

an outer knob portion freely rotating on said spindle, said outer knob portion including a second surface facing said first surface, said outer knob portion including a first section having a first mating edge and a second section having a second mating edge abutting said first mating edge to form an abutment line;

a first lug projecting from said second surface of said outer knob portion for engagement with a first notch formed in said side wall of said inner knob portion, said first and second sections of said outer knob portion being selectively movable in opposing directions along said abutment line to positively move said first lug into engagement with said first notch for enabling rotation of said spindle when said outer knob portion is rotated to move said latch from a normally latched position to an unlatched position; and a second lug extending from said second surface of said second section for engagement with a second notch formed in said side wall of said inner knob portion.

2. A knob assembly as claimed in claim 1 wherein a plurality of notches are formed at intervals in said side wall, said first and second notches being ones of said plurality of notches, and said first and second lugs are positionable into opposing pairs of said plurality of notches.

3. A knob assembly for a door comprising:

a spindle configured to extend through said door approximately perpendicular to a planar surface of said door;

a latch in communication with said spindle and extendable from an edge of said door, said latch being actuated in response to rotation of said spindle;

an inner knob portion fixedly secured to said spindle, said inner knob portion including a first surface;

an outer knob portion freely rotating on said spindle, said outer knob portion including a second surface facing said first surface, said outer knob portion including a first section having a first mating edge and a second section having a second mating edge abutting said first mating edge to form an abutment line, said first and second sections being movable in opposing directions along said abutment line;

a lug projecting from one of said first and second surfaces for engagement with a notch formed in another of said first and second surfaces, said first and second sections of said outer knob portion being selectively movable in opposing directions along said abutment line to positively move said lug into engagement with said notch for enabling rotation of said spindle when said outer knob portion is rotated to move said latch from a normally latched position to an unlatched position; and a resilient member positioned about a circumference of said outer knob portion for disengaging said lug from said notch.

4. A knob assembly for a door comprising:

a spindle configured to extend through said door approximately perpendicular to a planar surface of said door;

a latch in communication with said spindle and extendable from an edge of said door, said latch being actuated in response to rotation of said spindle;

an inner knob portion fixedly secured to said spindle, said inner knob portion including a first surface;

an outer knob portion freely rotating on said spindle, said outer knob portion including a second surface facing said first surface, said outer knob portion including:

a first section having a first mating edge; and a second section having a second mating edge abutting said first mating edge to form an abutment line;

a lug projecting from one of said first and second surfaces for engagement with a notch formed on another of said first and second surfaces, said first and second sections of said outer knob portion being movable in opposing directions along said abutment line to move said lug into positive engagement with said notch for enabling rotation of said spindle when said outer knob portion is rotated to move said latch from a normally latched position to an unlatched position;

means on said outer knob portion for indicating a hand placement strategy for selectively operating said outer knob portion; and a resilient member positioned about a circumference of said outer knob portion for disengaging said lug from said notch.

5. A knob assembly as claimed in claim 4 wherein said lug is a first lug, said notch is a first notch, and:

said first lug extends from said second surface of said first section for engagement in said first notch formed on said first surface of said inner knob portion; and said knob assembly further includes a second lug extending from said second surface of said second section for engagement with a second notch formed on said first surface of said inner knob portion.

6. A knob assembly for a door comprising:

a spindle configured to extend through said door approximately perpendicular to a planar surface of said door;

a latch in communication with said spindle and extendable from an edge of said door, said latch being actuated in response to rotation of said spindle;

an inner knob portion fixedly secured to said spindle, said inner knob portion including a first surface, a first notch and a second notch being formed on said first surface;

an outer knob portion freely rotating on said spindle, said outer knob portion including a second surface facing said first surface, said outer knob portion including:

a first section having a first mating edge; and a second section having a second mating edge abutting said first mating edge to form an abutment line;

a first lug projecting from said second surface of said first section;

a second lug projecting from said second surface of said second section, and said outer knob portion being selectively operable to move said first and second sections in opposing directions along said abutment line to move said first and second lugs into engagement with corresponding ones of said first and second notches for enabling rotation of said spindle when said outer knob portion is rotated to move said latch from a normally latched position to an unlatched position; and a resilient member positioned about a circumference of said outer knob portion for disengaging said first and second lugs from said first and second notches.

7. A knob assembly as claimed in claim 6 wherein each of said first and second mating edges comprises:

a first straight segment offset from a diameter of said outer knob portion in a first direction;

a second straight segment offset from said diameter of said outer knob portion in a second direction; and a curved segment interposed between said first and second straight segments, said curved segment crossing said diameter to interconnect said first and second straight segments.

8. A knob assembly as claimed in claim 6 wherein said inner knob portion includes a cavity extending inwardly from said first surface, said cavity is defined by a sidewall, and said first and second notches are formed in said sidewall.

* * * * *